US008029308B2

(12) United States Patent
Saruwatari

(10) Patent No.: US 8,029,308 B2
(45) Date of Patent: Oct. 4, 2011

(54) CONNECTOR HOLDING DEVICE

(75) Inventor: Naoto Saruwatari, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/811,445

(22) PCT Filed: Dec. 17, 2008

(86) PCT No.: PCT/JP2008/003803

§ 371 (c)(1),
(2), (4) Date: Jul. 1, 2010

(87) PCT Pub. No.: WO2009/095974

PCT Pub. Date: Aug. 6, 2009

(65) Prior Publication Data

US 2010/0285681 A1 Nov. 11, 2010

(30) Foreign Application Priority Data

Jan. 28, 2008 (JP) ..... 2008-016117
Aug. 27, 2008 (JP) ..... 2008-217692

(51) Int. Cl.
*H01R 13/62* (2006.01)
*H01R 13/64* (2006.01)

(52) U.S. Cl. ..... 439/373

(58) Field of Classification Search ..... 439/345, 439/369–371, 373, 374, 367, 352
See application file for complete search history.

(56) References Cited

U.S. PATENT DOCUMENTS 3,811,104 A * 5/1974 Caldwell ..... 439/135
5,348,495 A * 9/1994 Kasden ..... 439/371

FOREIGN PATENT DOCUMENTS

| | | | |
|---|---|---|---|
| JP | 58-34372 | U | 3/1983 |
| JP | 1-127180 | U | 8/1989 |
| JP | 03-257773 | A | 11/1991 |
| JP | 7-14575 | U | 3/1995 |
| JP | 7-16376 | U | 3/1995 |
| JP | 2001-135413 | A | 5/2001 |
| JP | 2005-038785 | A | 2/2005 |

OTHER PUBLICATIONS

International Search Report for PCT/JP2008/003803, Jan. 20, 2009.

* cited by examiner

*Primary Examiner* — Javaid Nasri
(74) *Attorney, Agent, or Firm* — RatnerPrestia

(57) ABSTRACT

A connector holding device includes a body-side connector attached to an apparatus body; a cord-side connector for fitting with the body-side connector, provided on the front end of a cord drawn out opposite to the side fitting with the body-side connector; and a connector holding member for holding the cord-side connector, having an opening formed with its cord side smaller than its side fitting with the body-side connector. The device attaches the connector holding member to the apparatus body in a state where the cord-side connector fits with the body-side connector.

11 Claims, 7 Drawing Sheets

CONNECTOR HOLDING DEVICE

This application is a U.S. National Phase Application of PCT International Application No. PCT/JP2008/003803.

TECHNICAL FIELD

The present invention relates to a connector holding device structured so that the connector at the side of a cord (e.g. a power cord detachable from an electronic appliance) is not easily disconnected from the connector at the side of the appliance body.

BACKGROUND ART

Conventionally, a cord (e.g. power cord) of an electronic appliance is detachable from the body of the appliance for easy handling and exchange. With this type of connector, a detached connector causes power interruption, or an almost detached connector can cause electric leakage due to imperfect contact between connectors.

To solve such a problem, a structure including a mechanism for locking connectors has been disclosed conventionally (refer to patent literature 1, for instance).

FIGS. 8A, 8B, and 8C are external perspective views of a locking mechanism of a conventional connector described in patent literature 1. As shown in FIG. 8A, the locking mechanism includes panel 11 of apparatus body 10, opening 12 provided in panel 11, and shielding plate 13 provided on panel 11. Shielding plate 13, attached to panel 11 rotatably centering on a supporting point (not shown), opens and shields opening 12. Shielding plate 13 is provided with notch 13*a* at the bottom-end edge thereof. Further, the connector locking mechanism includes connector 14. Connector 14 is attached to the inner part of opening 12 and electrically connected to a circuit (not shown) inside apparatus body 10.

As shown in FIG. 8B, with shielding plate 13, the arc center of a fan-shaped member having a pair of arc outer circumferences is pivotally supported to a fixed shaft (not shown), being vertically rotatable. Hence, vertically rotating shielding plate 13 makes connector 14 open to the outside and be shielded from the outside.

Power cord 21 has plug 22 on the front end thereof for electrically connecting to connector 14. Stage 23 on the back of plug 22 is formed smaller than plug 22.

In the locking mechanism of a conventional connector thus structured, shielding plate 13 attached to panel 11 of the apparatus body is first rotated upward to make connector 14 be in an open state. Next, plug 22 of power cord 21 is inserted through opening 12 to make connector 14 fit with plug 22 to be electrically connected.

After that, as shown in FIG. 8C, shielding plate 13 is rotated downward to make opening 12 of panel 11 shieldable. On this occasion, notch 13*a* provided at the bottom-end edge of shielding plate 13 fits with stage 23 on the back of plug 22. This structure allows plug 22 to be held in a space between shielding plate 13 and connector 14 to engage plug 22.

However, the following problem is found in the conventional connector locking mechanism described in above patent literature 1.

For instance, the locking mechanism can be released if the apparatus body is placed upside down or inclined, or if the cord is moved. An attempt to adequately work the locking mechanism causes shielding plate 13 to be vertically rotated with difficulty, resulting in attaching and detaching of the cord with difficulty. Further, shielding plate 13 needs to be made of a hard material, which causes damage and breakage due to a load added to stage 23 on the back of plug 22.

[Patent literature 1] Japanese Utility Model Unexamined Publication No. H07-14575

SUMMARY OF THE INVENTION

A connector holding device of the present invention includes a body-side connector, a cord-side connector, and a connector holding member. The body-side connector is attached to the apparatus body and electrically connected to an electric circuit inside the apparatus body. The cord-side connector fits with the body-side connector and is provided on the front end of a cord drawn out opposite to the side fitting with the body-side connector. The connector holding member holds the cord-side connector and has an opening formed with its cord side smaller than its side fitting with the body-side connector. The connector holding device is characterized in that the connector holding member is attached to the apparatus body in a state where the cord-side connector fits with the body-side connector.

Herewith, fitting between the body- and cord-side connectors can be made firm. The connector holding member formed of an elastic body reduces a load added to the cord-side connector.

REFERENCE MARKS IN THE DRAWINGS

Figure 1A:
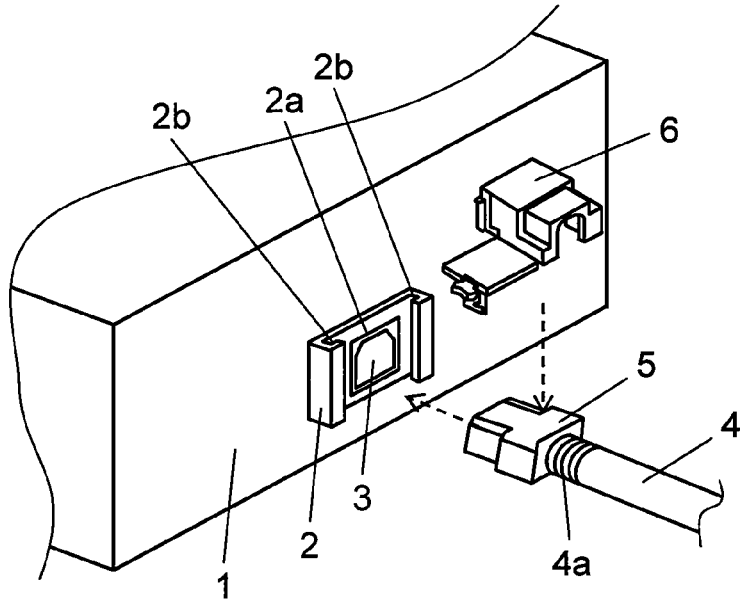
FIG. 1A is an external perspective view of a connector holding device according to the first exemplary embodiment of the present invention, showing a state before the connectors fit with each other.

1 Apparatus body
2 Guide
2*a* Opening
2*b* Groove
3 Body-side connector
3*c* Body-side connector substrate
3*d* AC inlet
4*a* Bellows
5 Cord-side connector
6 Connector holding member
6*a* Container
6*b* Hinge
6*c* Lid
6*d* Flange
6*e* First opening
6*f* Second opening
6*g* Locking part
6*h* Elastic part
6*i* Ratchet
6*j* Locking part inserting part
6*k* Ratchet hole
6*n* Third opening
7 Body attachment
7*a* Inside-body-attachment opening
8 Upper clamp
9 Lower clamp
20 Guide
30 Screw
31 Screw
32 Body-side connector holding part
33 Body opening

DETAILED DESCRIPTION OF PREFERRED EMBODIMENTS

Hereinafter, a description is made of some preferred embodiments of the present invention with reference to the related drawings.

First Exemplary Embodiment

Figure 1B:
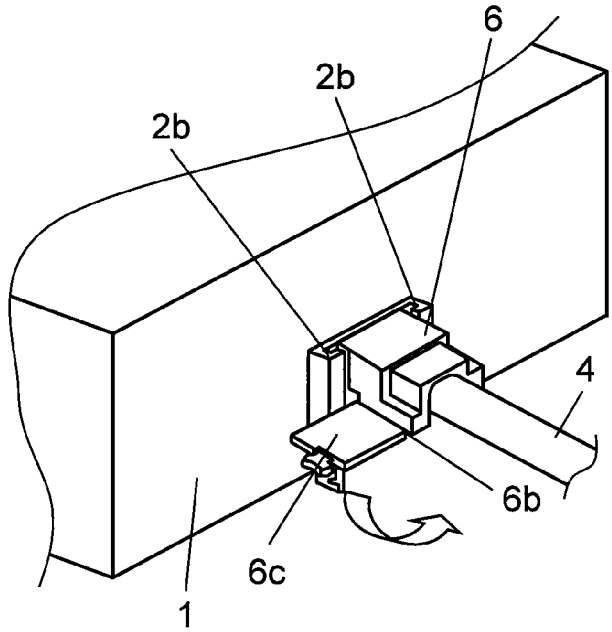
FIG. 1B is an external perspective view of the connector holding device according to the first exemplary embodiment of the present invention, in a state after the connectors fit with each other.
Figure 2A:
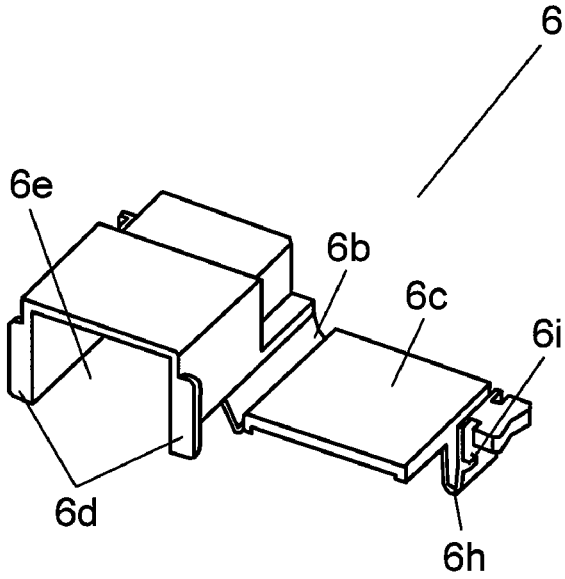
FIG. 2A is a detailed perspective view of the connector holding device according to the first exemplary embodiment of the present invention, viewed from the above.
Figure 2B:
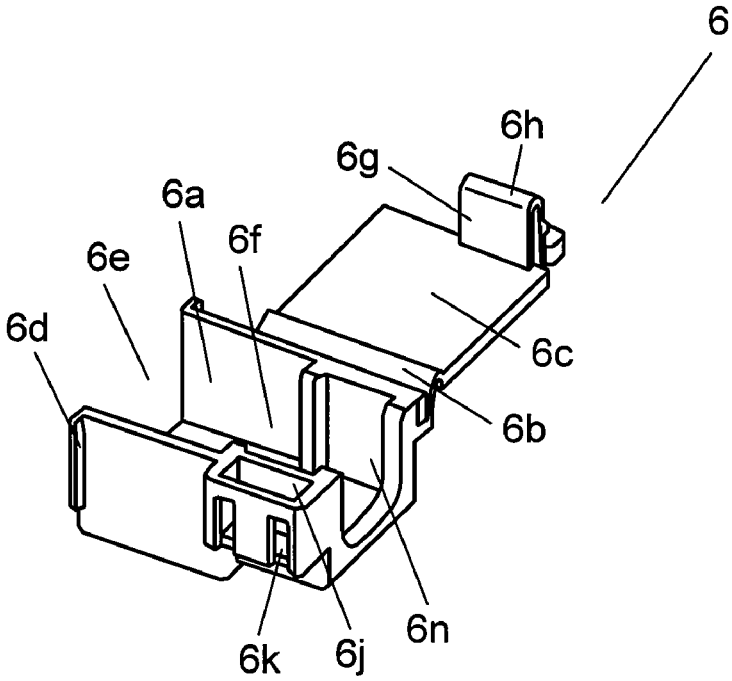
FIG. 2B is a detailed perspective view of the connector holding device according to the first exemplary embodiment of the present invention, viewed from the below.
Figure 3:
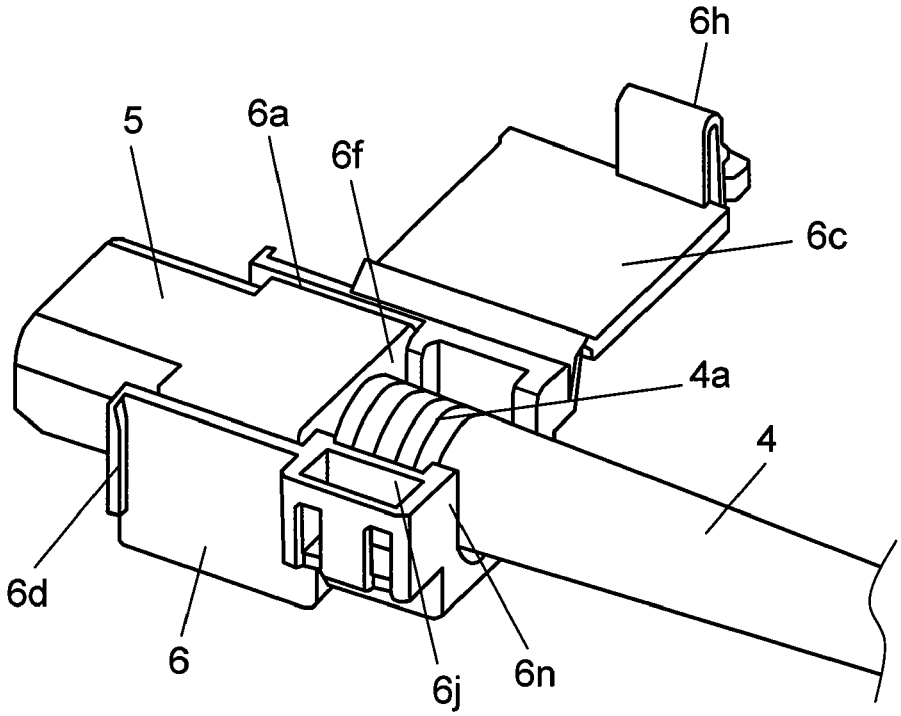
FIG. 3 is an external perspective view of the connector holding device according to the first exemplary embodiment of the present invention, in a state where a power cord is attached thereto.

FIGS. 1A and 1B are external perspective views of a connector holding device according to the first exemplary embodiment of the present invention, where FIG. 1A shows a state before the connectors fit with each other; FIG. 1B shows a state after. FIGS. 2A and 2B are detailed perspective views of connector holding member 6, where FIG. 2A shows a state viewed from the above; FIG. 2B, from the below. FIG. 3 is an external perspective view of connector holding device 6, in a state where power cord 4 is attached thereto.

First, a description is made of a configuration of the connector holding device according to the embodiment. As shown in FIGS. 1A and 1B, the connector holding device includes guide 2, body-side connector 3, cord-side connector 5, and connector holding member 6. Guide 2 is attached to apparatus body 1 (i.e. an electronic appliance). Body-side connector 3 is electrically connected to an electric circuit inside apparatus body 1. Cord-side connector 5 fits with body-side connector 3 and is provided on the front end of power cord 4 drawn out opposite to the side fitting with body-side connector 3. Connector holding member 6 holds cord-side connector 5.

In other words, as shown in FIG. 1A, apparatus body 1 as an electronic appliance is provided with body-side connector 3 of the connector holding device. Guide 2 placed near body-side connector 3 of apparatus body 1 is provided with two grooves 2*b* with body-side connector 3 placed therebetween, to the right and left of opening 2*a* parallel to each other. Then, body-side connector 3 is attached to the inner part of opening 2*a* and is electrically connected to an electric circuit (not shown) inside apparatus body 1. Here, the above-described guide 2 is desirably close to apparatus body 1 to the utmost from the aspect of the strength of holding apparatus body 1 and connector holding member 6 and of downsizing of the connector holding device.

Power cord 4 has cord-side connector 5 and its joint is formed as bellows 4*a* to move power cord 4 flexibly.

As shown in FIGS. 2A and 2B, connector holding member 6 is composed of substantially U-shaped container 6*a* for containing cord-side connector 5 of power cord 4; lid 6*c* connected to container 6*a* with hinge 6*b*, for covering container 6*a*; and flange 6*d* provided at both ends of substantially U-shaped container 6*a*. Hence, connector holding member 6 has a flange fitting into the guide. Container 6*a* has openings at its front and back. First opening 6*e* is formed wide enough to contain cord-side connector 5. Second opening 6*f* is formed with a width smaller than cord-side connector 5. In other words, connector holding member 6 has second opening 6*f* that is an opening formed with its side of power cord 4 smaller than its side fitting with body-side connector 3.

Here, as shown in FIG. 3, the distance between first opening 6*e* and second opening 6*f* is set to be in necessary and sufficient length to secure electrical connection between cord-side connector 5 and body-side connector 3 when they fit with each other.

Locking part 6*g* provided on lid 6*c* includes elastic part 6*h* and ratchet 6*i*. Then, part 6*g* is formed so as to be inserted into locking part inserting part 6*j*. The side of part 6*j* is provided therein with ratchet hole 6*k* into which ratchet 6*i* fits. Third opening 6*n* through which power cord 4 is drawn out has an allowance in width for the thickness of power cord 4. As described above, lid 6*c* of connector holding member 6 has locking part 6*g* so as to be locked therewith while covering container 6*a*.

Hereinafter, a description is made of the procedure for assembling the connector holding device of the embodiment structured as the above.

First, cord-side connector 5 of power cord 4 is made fit with body-side connector 3 attached to the inner part of opening 2*a* to electrically connect cord-side connector 5 to body-side connector 3.

Next, substantially U-shaped container 6*a* is turned upside down, and connector holding member 6 is made fit with cord-side connector 5 like covering it from the above. Simultaneously, connector holding member 6 is fitted into guide 2 provided near body-side connector 3 of the apparatus body. In other words, while cord-side connector 5 is held with connector holding member 6, two flanges 6*d* provided on connector holding member 6 are slided into grooves 2*b* to the right and left of guide 2 to fit into grooves 2*b*.

After that, as shown in FIG. 1B, lid 6*c* of connector holding member 6 is rotated centering on hinge 6*b* as shown by the arrow to cover container 6*a*. Next, when locking part 6*g* is inserted into locking part inserting part 6*j*, elastic part 6*h* is once contracted; ratchet 6*i* is engaged into ratchet hole 6*k*; and elastic part 6*h* returns, resulting in locking part inserting part 6*j* not being detached. Consequently, lid 6*c* is locked. Herewith, cord-side connector 5 is held by connector holding member 6 and locked to apparatus body 1.

As shown in FIG. 3, when cord-side connector 5 of power cord 4 is held by connector holding member 6, connector 5 is contained in substantially U-shaped container 6*a*. Here, connector 5 does not slip through second opening 6*f* because opening 6*f* is formed with a width smaller than cord-side connector 5. Further, imperfect contact does not occur when cord-side connector 5 fits with body-side connector 3 because the distance between first opening 6*e* and second opening 6*f* is set to be in necessary and sufficient length to secure electrical connection between both connectors. Movement of power cord 4, moving flexibly owing to bellows 4*a*, is not restricted, or its coating is not damaged because third opening 6*n* has an allowance in width.

Connector holding member 6 itself may be formed of an elastic body. In this way, third opening 6*n* does not need to have an allowance in width. In this case, it is adequate if the following conditions are met. That is, the width of substantially U-shaped container 6*a* of connector holding member 6 is nearly the same as that of cord-side connector 5, and the distance between grooves 2*b* to the right and left of guide 2 provided on apparatus body 1 is nearly the same as the outer width of substantially U-shaped container 6*a*. Consequently, even if flange 6*d* of connector holding member 6 is elastic, flange 6*d* is not detached from grooves 2*b*. Here, examples of an elastic body forming connector holding member 6 include ABS resin and polyamide resin (PA6).

To detach cord-side connector 5 of power cord 4 from body-side connector 3, lid 6*c* is opened by pressing ratchet 6*i* inwardly from outside ratchet hole 6*k* to once contract elastic part 6*h*. Then, two flanges 6*d* of connector holding member 6 are slided into grooves 2*b* to the right and left of guide 2 with lid 6*c* completely open, thereby allowing connector holding member 6 to be detached from cord-side connector 5.

After that, cord-side connector 5 of power cord 4 can be detached from body-side connector 3.

In this embodiment, a type is described in which connector holding member 6 is vertically slided to be inserted into guide 2 of apparatus body 1 and detached from guide 2. Instead, a type is also easily practicable in which member 6 is horizontally slided with the same mechanism. In this case, the direction of guide 2 of apparatus body 1 has only to be changed accordingly.

Consequently, as described above, the connector holding device according to the embodiment is equipped with guide 2 into which connector holding member 6 is inserted, near body-side connector orthogonally to the direction in which cord-side connector 5 fits with body-side connector 3. In this way, the connector holding device of the embodiment prevents electric leakage due to imperfect contact between connectors because cord-side connector 5 of power cord 4 cannot be detached from body-side connector 3 with connector holding member 6 attached (the connectors are not easily disconnected).

In this embodiment, the description is made instancing a power cord and connectors. The present invention, however, is applicable to other cables such as a signal cable and connectors, where fitting between the body- and cord-side connectors is made not be detached easily. Further, forming the connector holding member of an elastic body reduces a load added to the cord-side connector.

Second Exemplary Embodiment

In the first exemplary embodiment, apparatus body 1 and connector holding member 6 are fixed so as not to be detached easily by sliding two flanges 6*d* of connector holding member 6 into grooves 2*b* to the right and left of guide 2 provided on apparatus body 1 and inserting the flanges into the grooves. The second embodiment, however, is different from the first one in that the second one includes a body attachment with a guide provided, and upper and lower clamps for fixing the attachment. A detailed description is omitted of a component and its operation same as those of the first embodiment.

Figure 4:
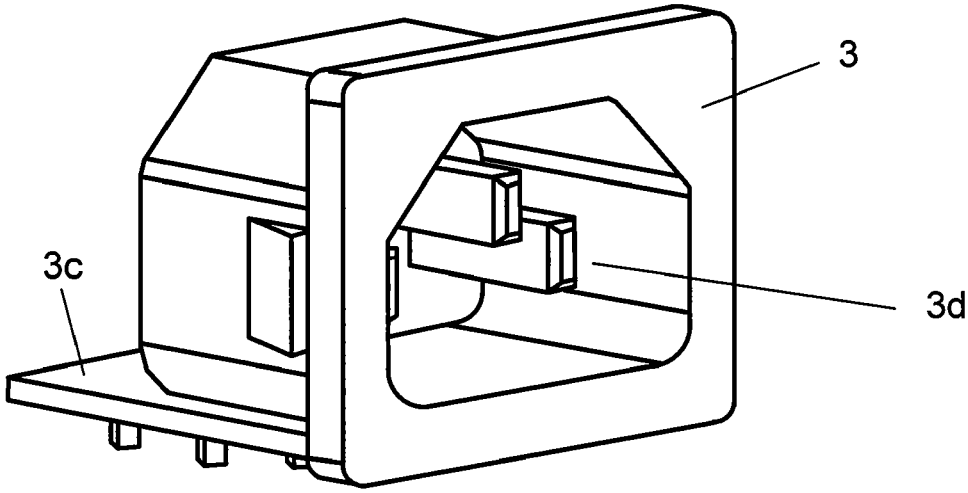
FIG. 4 shows a state where only the body-side connector of a connector holding device according to the second exemplary embodiment of the present invention is mounted on the substrate of the body-side connector.

FIG. 4 shows a state where only body-side connector 3 of the second embodiment is mounted on body-side connector substrate 3*c*. As shown in FIG. 4, body-side connector substrate 3*c* has body-side connector 3 including AC inlet 3*d* mounted thereon. Inlet 3*d* is wired to an electric circuit (not shown) inside apparatus body 1 through a lead wire.

Figure 5:
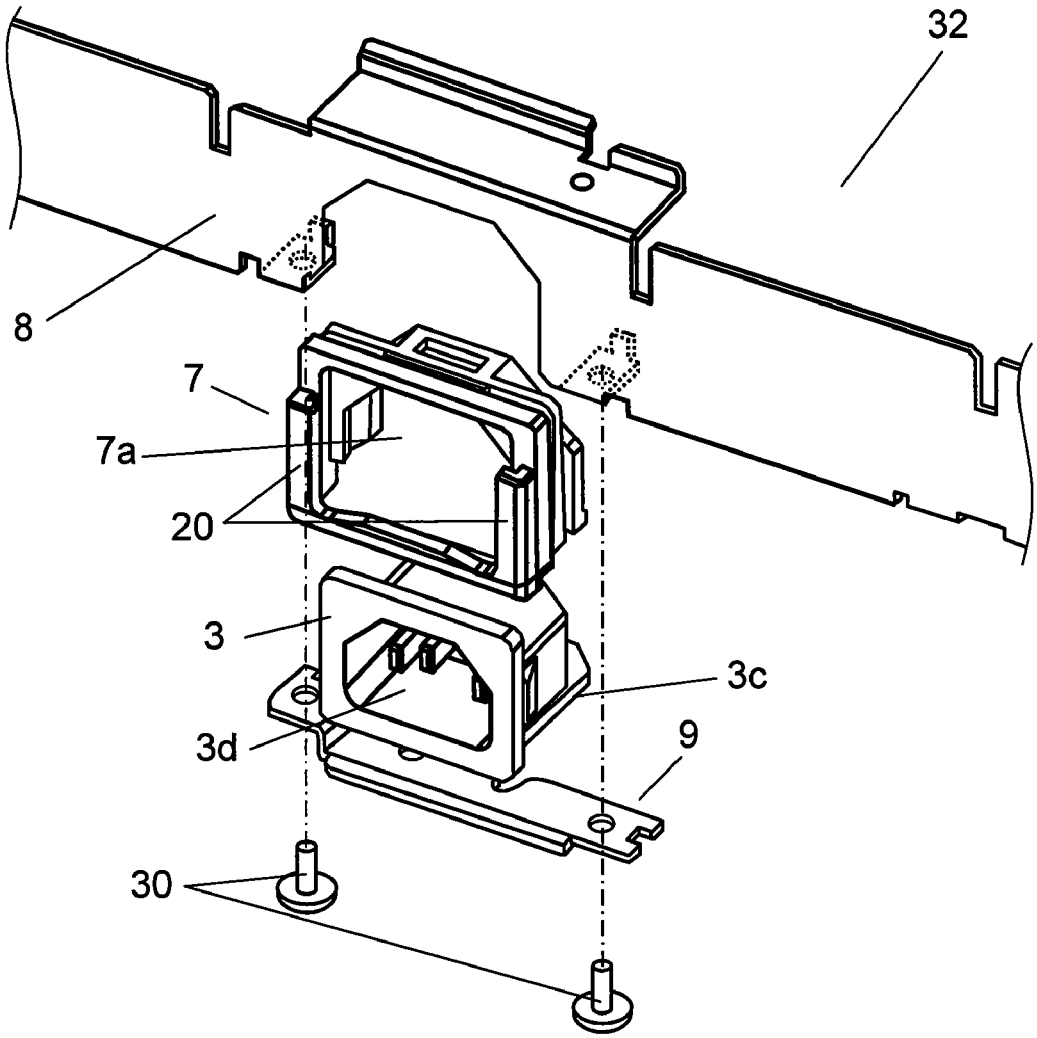
FIG. 5 is a exploded view according to the second exemplary embodiment of the present invention, showing the configuration of the body-side connector holding part of the connector holding device.

FIG. 5 is a exploded view showing the configuration of body-side connector holding part 32 of the connector holding device according to the embodiment. The connector holding device includes body-side connector holding part 32 at the side of apparatus body 1. As shown in FIG. 5, part 32 includes body-side connector substrate 3*c*, body-side connector 3, body attachment 7, upper clamp 8, lower clamp 9, and screws 30. Body-side connector 3 is mounted on body-side connector substrate 3*c*. Body attachment 7 has inside-body-attachment opening 7*a* as a part fitting with body-side connector 3, and guide 20 as a part fitting with cord-side connector 5. In other words, inside-body-attachment opening 7*a* is formed in a shape so as to exactly fit with the outside shape of body-side connector 3. Upper clamp 8 and lower clamp 9 hold body attachment 7 from the above and below. Screws 30 fix upper clamp 8 with lower clamp 9. FIG. 5 shows the configuration in a developed (exploded) state.

Figure 6:
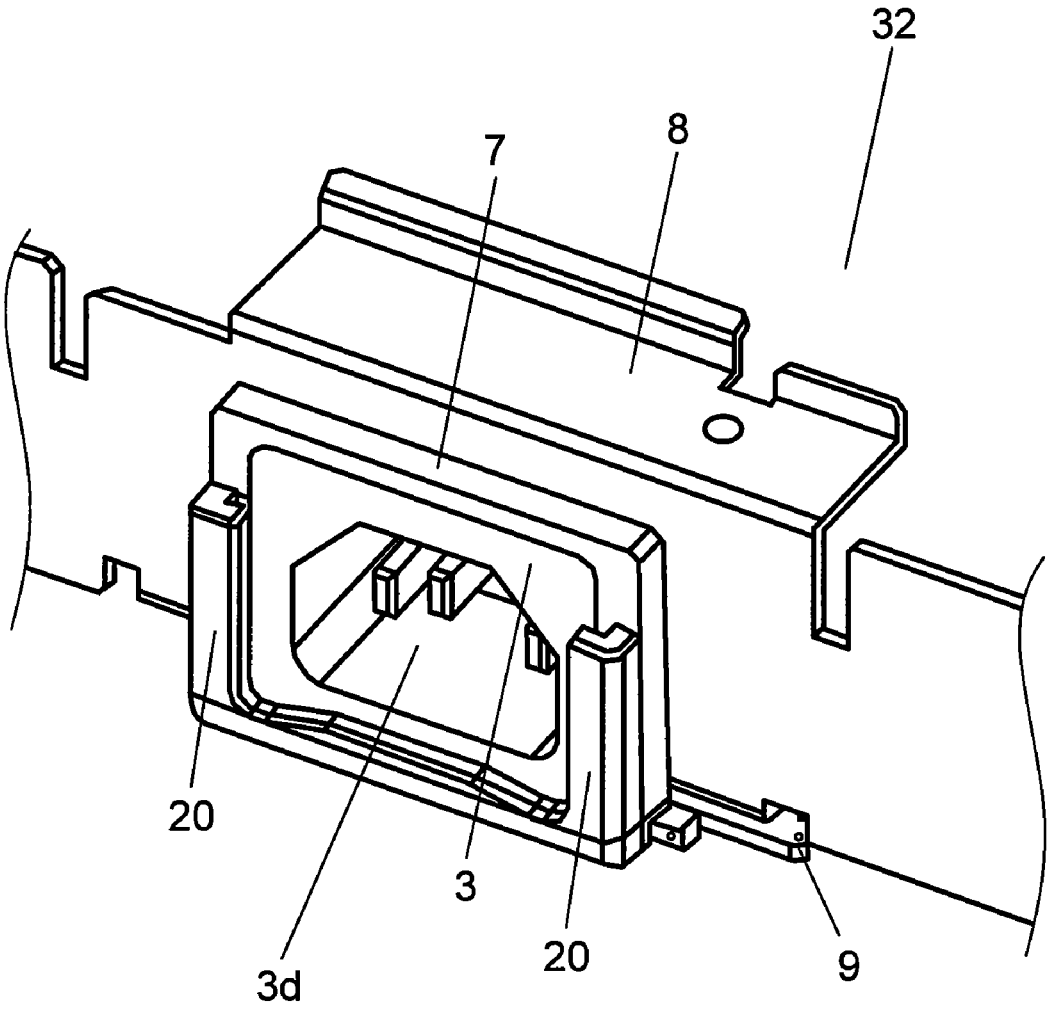
FIG. 6 shows a holding state of the body-side connector holding part according to the second exemplary embodiment of the present invention.
Figure 7:
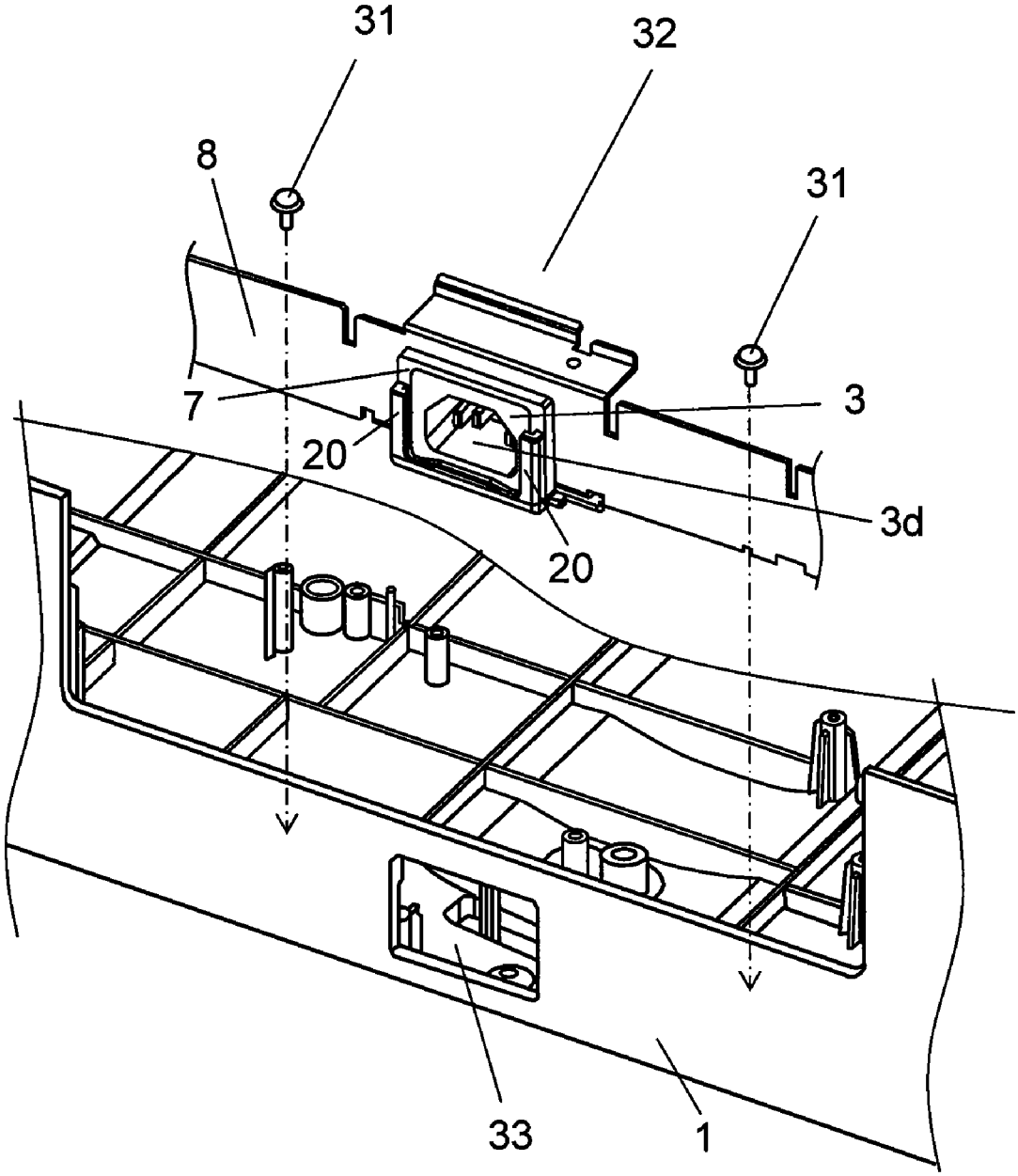
FIG. 7 is a exploded view of the configuration showing how the body-side connector holding part is fixed to the apparatus body.
Figure 8A:
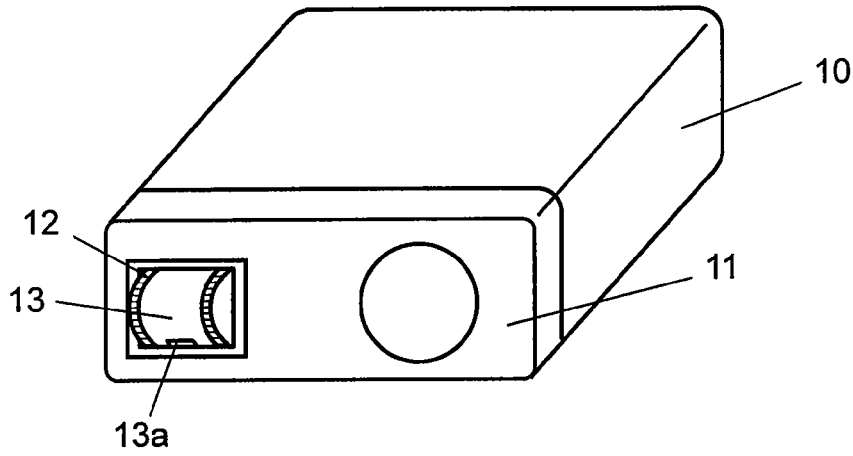
FIG. 8A PRIOR ART
FIG. 8A is an external perspective view of locking mechanism of conventional connector.
Figure 8B:
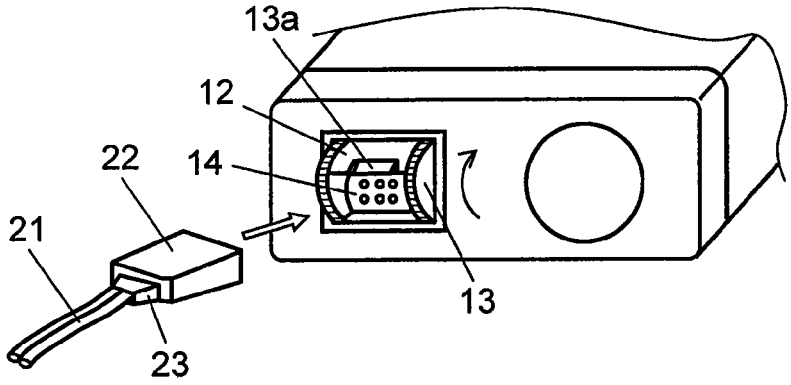
FIG. 8B PRIOR ART
FIG. 8B is another external perspective view of the locking mechanism of conventional connector.
Figure 8C:
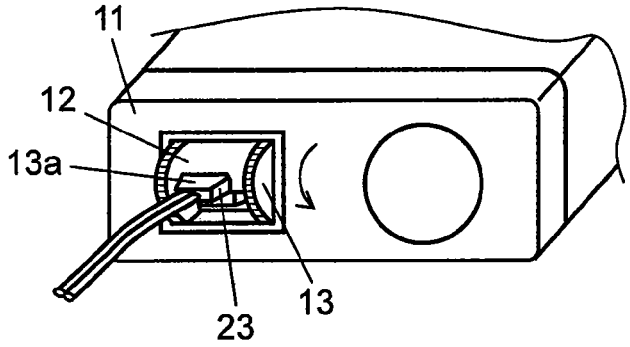
FIG. 8C PRIOR ART
FIG. 8C is yet another external perspective view of the locking mechanism of conventional connector.

FIG. 6 shows a holding state of body-side connector holding part 32 of the connector holding device according to the embodiment. FIG. 7 is a exploded view of a configuration showing how body-side connector holding part 32 shown in FIG. 6 is fixed to apparatus body 1.

Hereinafter, a description is made of the procedure for assembling the connector holding device of the embodiment structured as the above.

First, as shown in FIGS. 5 and 6, body-side connector 3 mounted on body-side connector substrate 3*c* is inserted and incorporated into inside-body-attachment opening 7*a* of body attachment 7 to make body attachment 7 alone hold body-side connector 3. In other words, body-side connector substrate 3*c* has body-side connector 3 mounted thereon and is held by body attachment 7 together with body-side connector 3. Guide 20 provided on body attachment 7 works as a part fitting with cord-side connector 5.

Next, body attachment 7 is held by upper clamp 8 and lower clamp 9. Then clamps 8 and 9 clamp body attachment 7 and are fixed with screws 30. As shown in FIG. 6, body-side connector holding part 32 is thus assembled and enters a holding state.

Here, in FIG. 5, a way is shown in which upper clamp 8 is screwed with lower clamp 9 near both sides of body attachment 7. However, one side is screwed and the other side may be swaged or fitted. Instead of screwing, spot welding may be used.

After that, as shown in FIG. 7, body-side connector holding part 32 in a holding state is fixed to apparatus body 1 with screws 31. On this occasion, the part of body attachment 7 containing guide 20 is fitted into body opening 33 of apparatus body 1 for assembling. In a state of assembling completed, body-side connector 3 is fitted into body attachment 7 and held by body attachment 7, and is movable into and out of apparatus body 1. Here, the example is shown in which body-side connector holding part 32 is fixed to the bottom surface of apparatus body 1 with screws 31, but the present invention is not limited to the example. For instance, part 32 may be screwed near body opening 33 or fixed by such as spot welding.

Then, in the same way as in the first embodiment, cord-side connector 5 of power cord 4 is made fit with body-side connector 3 to electrically connect them with each other.

Next, substantially U-shaped container 6*a* is turned upside down, and connector holding member 6 is made fit with cord-side connector 5 like covering it from the above. Simultaneously, connector holding member 6 is fitted into guide 20. In this way, upper clamp 8 is fixed to apparatus body 1 with screws 31; however, body-side connector 3 is not directly fixed to apparatus body 1. Hence, guide 20 is independent of body-side connector 3 while holding connector holding member 6, allowing guide 20 to move synchronously with connector holding member 6.

As in the first embodiment, flange 6*d* of connector holding member 6 can be easily detached from guide 2 when power cord 4 is pulled to the right and left in a state of body-side connector 3 fixed to apparatus body 1. However, AC inlet 3*d* is fixed with body attachment 7 having guide 20, which allows the cord and connector holding member 6 attached to the connector to move following body attachment 7 even if body-side connector 3 is pried, and thus connector holding member 6 is not detached easily.

Body-side connector substrate 3*c* has AC inlet 3*d* mounted thereon, but does not have body attachment 7. Consequently, body attachment 7 is held by being clamped with upper clamp 8 and lower clamp 9, and thus a load is not added to a solder part of body-side connector substrate 3*c* even if the cord is moved up and down, or to the right and left.

Herewith, body attachment 7 can move following the cord without adding a load to the solder part of body-side connector substrate 3*c*, and thus body attachment 7 is not detached easily, thereby preventing cracks from occurring in the solder part of substrate 3*c*.

Industrial Applicability

A connector holding device according to the present invention is applicable to a case where a cord-side connector is connected to a body-side connector, and is useful in a case where various types of plugs are connected to various types of connectors or to a wall socket (e.g. a power cable for AC or DC to a DC adaptor, and a periphery device to a personal computer).

The invention claimed is:

1. A body-side connector attached to an apparatus body and electrically connected to an electric circuit inside the apparatus body;

a cord-side connector for fitting with the body-side connector and provided at a front end of a cord drawn out opposite to a side fitting with the body-side connector;

a connector holding member for holding the cord-side connector, the connector holding member having a flange and an opening formed with a cord side thereof smaller than a side thereof fitting with the body-side connector; and a guide for allowing the connector holding member to fit thereinto, the guide provided near the body-side connector and having grooves extending in a direction orthogonal to an insertion direction of the cord-side connector into the body-side connector, the flange of the connector holding member configured to slide into the grooves in the direction in which the grooves extend.

2. The connector holding device of claim 1, wherein the connector holding member has a U-shaped, gutter-formed container for containing the cord-side connector, and a lid connected to the connector holding device with a hinge so as to cover the container.

3. The connector holding device of claim 2, wherein the lid of the connector holding member has a locking part and is locked with the locking part while covering the container.

4. The connector holding device of claim 2, wherein the locking part has an elastic part and a ratchet, and the lid is locked by the ratchet engaging a ratchet hole of the connector holding member.

5. The connector holding device of claim 4, wherein the connector holding member is formed of an elastic body.

6. The connector holding device of claim 3, wherein the connector holding member is formed of an elastic body.

7. The connector holding device of claim 2, wherein the connector holding member is formed of an elastic body.

8. The connector holding device of claim 1, further comprising:

a body attachment having a guide as a part for fitting with the cord-side connector;

an upper clamp and a lower clamp for fixing the body attachment; and a body-side connector holding part fixed to an apparatus body, wherein the guide holds the connector holding member, is independent of the body-side connector, and moves synchronously with the connector holding member.

9. The connector holding device of claim 8, wherein the body attachment makes the body-side connector fit into an opening of the body attachment and holds the body-side connector, and is held to the apparatus body with the upper clamp and the lower clamp.

10. The connector holding device of claim 9, wherein the upper clamp and the lower clamp clamp the body attachment and fix the body attachment with a screw.

11. The connector holding device of claim 1, further comprising a body-side connector substrate, wherein the body-side connector substrate has the body-side connector mounted thereon and is held by the body attachment together with the body-side connector.

* * * * *

UNITED STATES PATENT AND TRADEMARK OFFICE

CERTIFICATE OF CORRECTION

PATENT NO. : 8,029,308 B2
APPLICATION NO. : 12/811445
DATED : October 4, 2011
INVENTOR(S) : Naoto Saruwatari It is certified that error appears in the above-identified patent and that said Letters Patent is hereby corrected as shown below:

Column 8, line 19, "claim 2," should read --claim 3,--

Signed and Sealed this
First Day of May, 2012

David J. Kappos

David J. Kappos
*Director of the United States Patent and Trademark Office*